US011131027B2

(12) United States Patent
Vonk et al.

(10) Patent No.: US 11,131,027 B2
(45) Date of Patent: Sep. 28, 2021

(54) METAL PRETREATMENT COMPOSITION CONTAINING ZIRCONIUM, COPPER, ZINC AND NITRATE AND RELATED COATINGS ON METAL SUBSTRATES

(71) Applicant: Henkel AG & Co. KGaA, Duesseldorf (DE)

(72) Inventors: Donald Vonk, Clinton Township, MI (US); Edis Kapic, Lake Orion, MI (US); Bruce Goodreau, Romeo, MI (US); Alvaro Bobadilla, Royal Oak, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 455 days.

(21) Appl. No.: 15/961,262

(22) Filed: Apr. 24, 2018

(65) Prior Publication Data

US 2018/0237918 A1 Aug. 23, 2018

Related U.S. Application Data

(60) Division of application No. 13/531,666, filed on Jun. 25, 2012, now Pat. No. 9,970,115, which is a continuation of application No. PCT/US2010/062123, filed on Dec. 27, 2010.

(60) Provisional application No. 61/290,324, filed on Dec. 28, 2009.

(51) Int. Cl.
*C23C 22/34* (2006.01)
*C23C 22/00* (2006.01)

(52) U.S. Cl.
CPC ..... *C23C 22/34* (2013.01); *Y10T 428/12139* (2015.01)

(58) Field of Classification Search
CPC ..... C25D 13/20; B05D 1/007; B05D 7/14; B05D 7/51; C09D 5/12; C09D 5/44
See application file for complete search history.

(56) References Cited

U.S. PATENT DOCUMENTS

| | | | |
|---|---|---|---|
| 1,710,743 | A | 4/1929 | Pacz |
| 4,643,778 | A | 2/1987 | Donofrio |
| 5,342,456 | A | 8/1994 | Dolan |
| 5,584,946 | A | 12/1996 | Karmaschek et al. |
| 6,419,731 | B2 | 7/2002 | Inbe et al. |
| 6,764,553 | B2 | 7/2004 | Dolan |
| 7,063,735 | B2 | 6/2006 | Fristad et al. |
| 7,510,612 | B2 | 3/2009 | Matsukawa et al. |
| 7,531,051 | B2 | 5/2009 | Nakayama et al. |
| 7,819,989 | B2 | 10/2010 | Ishikura et al. |
| 8,815,021 | B2 | 8/2014 | Brouwer et al. |
| 2003/0150524 | A1 | 8/2003 | Wichelhaus et al. |
| 2004/0054044 | A1 | 3/2004 | Bittner et al. |
| 2004/0170840 | A1* | 9/2004 | Matsukawa ..... C23C 22/34 428/422.8 |
| 2004/0187967 | A1 | 9/2004 | Matsukawa et al. |
| 2005/0067057 | A1 | 3/2005 | Ishikura et al. |
| 2008/0057304 | A1 | 3/2008 | Fristad et al. |
| 2008/0230395 | A1 | 9/2008 | Inbe et al. |
| 2008/0302448 | A1 | 12/2008 | Frey et al. |
| 2009/0232996 | A1 | 9/2009 | Goodreau et al. |

FOREIGN PATENT DOCUMENTS

| | | | |
|---|---|---|---|
| CN | 1159835 | A | 9/1997 |
| CN | 1179182 | A | 4/1998 |
| CN | 1510165 | A | 7/2004 |
| CN | 1510166 | A1 | 7/2004 |
| CN | 1510168 | A | 7/2004 |
| CN | 101395299 | A | 3/2009 |
| DE | 764929 | C | 4/1954 |
| DE | 1933013 | A1 | 1/1971 |
| EP | 1405933 | A1 | 4/2004 |
| EP | 1433875 | A1 | 6/2004 |
| EP | 1433877 | A1 | 6/2004 |
| EP | 1433878 | A1 | 6/2004 |
| EP | 1571237 | A1 | 9/2005 |
| EP | 1489198 | B1 | 4/2008 |
| EP | 1997934 | A1 | 12/2008 |
| EP | 1997936 | A1 | 12/2008 |
| EP | 2154266 | A | 2/2010 |
| JP | 2004218073 | A | 8/2004 |
| JP | 2005264230 | A | 9/2005 |
| KR | 100326612 61 | | 11/2002 |

(Continued)

OTHER PUBLICATIONS

Supplementary EP Search Report for EP 10844243.5 dated Oct. 5, 2017.
International Search Report for PCT/US2010/062123, dated Aug. 30, 2011, 4 pages. All references cited in the International Search Report are listed herein.
International Search Report for PCT/US09/373372, dated May 15, 2009, 1 page. All references cited in the International Search Report are listed herein.
International Search Report for PCT/EP2009/053109, dated Jun. 30, 2009, 3 pages. All references cited in the International Search Report are listed herein.
German Search Report for PCT/EP2009/053109, dated Feb. 5, 2009, 4 pages. All references cited in the German Search Report are listed above.

(Continued)

*Primary Examiner* — Lois L Zheng
(74) *Attorney, Agent, or Firm* — Mary K. Cameron

(57) ABSTRACT

A pretreatment composition for metal that provides enhanced corrosion resistance, enhanced paint adhesion and reduced chip damage to a wide variety of metal substrates. The pretreatment is also cleaner because it is based on zirconium rather than zinc phosphates. The pretreatment coating composition in use preferably comprises 50 to 300 parts per million (ppm) zirconium, 0 to 100 ppm of $SiO_2$, 150-2000 ppm of total fluorine and 10-100 ppm of free fluorine, 150 to 10000 ppm of zinc and 10 to 10000 ppm of an oxidizing agent and has a pH of 3.0 to 5.0, preferably about 4.0. The coating composition can optionally include 0 to 50 ppm of copper. The suitable oxidizing agents can be selected from a large group.

32 Claims, No Drawings

(56) References Cited

FOREIGN PATENT DOCUMENTS

| | | | |
|---|---|---|---|
| KR | 1020040058039 | A1 | 7/2004 |
| KR | 1020040058040 | A1 | 7/2004 |
| WO | 8505131 | A1 | 11/1985 |
| WO | 9305198 | A1 | 3/1993 |
| WO | 9320260 | A1 | 10/1993 |
| WO | 2004063291 | A2 | 7/2004 |
| WO | 2006108655 | A1 | 10/2006 |
| WO | 2007065645 | A1 | 6/2007 |
| WO | 2008075739 | A1 | 6/2008 |
| WO | 2008133047 | A1 | 11/2008 |
| WO | 2010004651 | A1 | 1/2010 |

OTHER PUBLICATIONS

Lange's Handbook of Chemistry, 15th Ed., McGraw-Hill, 1999, Table 8.6, in an office action for U.S. Appl. No. 12/884,359 dated Oct. 27, 2011.

Supplementary European Search Report for EP 09722358, dated Aug. 13, 2014.

* cited by examiner

METAL PRETREATMENT COMPOSITION CONTAINING ZIRCONIUM, COPPER, ZINC AND NITRATE AND RELATED COATINGS ON METAL SUBSTRATES

This application is a divisional of U.S. patent application Ser. No. 13/531,666, filed Jun. 25, 2012, which is a continuation of PCT/US2010/062123, filed Dec. 27, 2010, which claims the benefit of U.S. Provisional Application Ser. No. 61/290,324, filed Dec. 28, 2009, each of which is incorporated herein by reference.

FIELD OF THE INVENTION

This invention relates generally to zirconium based pretreatment coating compositions, in particular, zirconium based pretreatment coating compositions that include zinc and oxidizing agents and that can be applied to metal substrates to enhance corrosion resistance. The invention also relates to the coatings obtained from the pretreatment coating compositions and the method of forming a pretreatment coating on a metal substrate.

BACKGROUND OF THE INVENTION

An anti-corrosion pretreatment coating is often applied to metal substrates, especially metal substrates that contain iron such as steel, prior to the application of a protective or decorative coating. The pretreatment coating minimizes the amount of corrosion to the metal substrate, if and when, the metal substrate is exposed to moisture and oxygen. Many of the present pretreatment coating compositions are based on metal phosphates, and rely on a chrome-containing rinse. The metal phosphates and chrome rinse solutions produce waste streams that are detrimental to the environment. As a result, there is the ever-increasing cost associated with their disposal. Thus, there is a desire to develop pretreatment coating compositions and methods of applying such compositions without producing metal phosphate and chrome waste solutions. It is also preferred, that these pretreatment coating compositions be effective in minimizing corrosion on a variety of metal substrates because many objects of commercial interest contain more than one type of metal substrate. For example, the automobile industry often relies on metal components that contain more than one type of metal substrate. The use of a pretreatment coating composition effective for more than one metal substrate would provide a more streamlined manufacturing process.

The coating compositions of the present invention are called pretreatment coatings because they are typically applied after the substrate has been cleaned and before the various decorative coatings have been applied. In the automotive industry these decorative coatings often comprise the following layers in order from the substrate out: a pretreatment coating for corrosion resistance, an electrodeposited electrocoat, then a primer layer, a base coat paint, and then a top clear coat. One such pretreatment coating is the Bonderite® system available from Henkel Adhesive Technologies. The Bonderite® systems are conversion coatings that are zinc-phosphate based and include zinc, nickel, manganese and phosphate. Currently, Bonderite® 958 is a standard conversion coating used extensively in the automotive industry. In attempts to move away from conversion coatings that include heavy metals and that produce phosphate waste streams a new class of environmentally friendly conversion coatings have been created. These are exemplified by the TecTalis® line of coatings available from Henkel Adhesive Technologies, certain Oxsilan® products available from Chemetall GmbH and the Zircobond® line from PPG Industries, which are based on a zirconium coating technology, have no phosphates and no nickel or manganese. In particular TecTalis® 1800 is finding increasing use in the automotive industry as a pretreatment coating. While the new zirconium based coatings provide adequate protection for most applications, paint adhesion and corrosion resistance for some applications is not as effective as with the old zinc-phosphate based coatings and solutions to this problem have not been forthcoming.

It is desirable to provide increasing functionality in terms of enhanced corrosion protection, improved paint adhesion, and thinner layers in pretreatment coatings. It is desirable to develop this enhanced functionality in a zirconium based pretreatment coating composition for the reasons noted above related to their reduced environmental issues. At the same time these improvements preferably to do not require changes to existing industrial processing lines and procedures thereby allowing the new pretreatment coating composition to be readily substituted into existing processes.

SUMMARY

In general terms, this invention provides an enhanced zirconium based conversion coating pretreatment that offers superior corrosion protection compared to current zirconium based pretreatment coatings. The enhancements provide improved corrosion resistance, thinner coating layers and enhanced paint adhesion as determined by resistance to chipping. Throughout the present specification and claims the levels of components in the invention pretreatment coating are expressed in parts per million (ppm) in the coating composition as used unless noted otherwise. The invention comprises a zirconium based pretreatment coating composition that further includes zinc ions and at least one oxidizing agent. The zirconium is preferably present in the pretreatment coating composition as used at a level of from 50 to 300 ppm, more preferably from 75 to 300 ppm. The level of zirconium in ppm ranges upward from, in order of increasing preference, 50, 75, 100, 125, 150, 175, 200 and ranges downward from, in order of increasing preference, 300, 275, 250, 225, 200. The zinc is preferably present at levels of from 150 to 10,000 ppm in the pretreatment coating composition. Preferably, the level of zinc in ppm ranges upward from, in order of increasing preference, 150, 300, 600, 900, 1200, 1500, 1800, 2100, 2400, 2700, 3000, 3300, 3600, 3900, 4200, 4500, 4800, 5000 and downward from, in order of increasing preference, 10000, 9700, 9400, 9100, 8800, 8500, 8200, 7900, 7600, 7300, 7000, 6700, 6400, 6100, 5800, 5500, 5200, 5000. The oxidizer agent can include oxidizing ions and salts thereof and may include a mixture of oxidizing agents. Especially preferred in the present invention is use of nitrate salts and ions as the oxidizing agent. Examples of suitable nitrates include ammonium nitrate, sodium nitrate and potassium nitrate. Other oxidizing agents, as ions or salts, that are expected to be able to replace or enhance the function of the nitrate ion include: nitrite ion, inorganic peroxides, permanganate ion, persulfate ion, perborate ion, chlorate ion, hypochlorite ion, vanadate ion, vanadyl ion, ceric ion, tungstate ion, stannic ion, hydroxylamines $R_2$—NOH, nitro-compounds R—$NO_2$, amine oxides $R_3$—NO and hydrogen peroxide. Examples of useful sources of these include: sodium nitrite, sodium peroxide, potassium permanganate, sodium persulfate, sodium perborate, sodium chlorate, sodium hypochlorite, sodium vanadate, vanadyl sulfate, ceric sulfate, ceric ammonium sulfate, ceric ammonium nitrate, sodium tungstate, stannic fluoride, hydroxylamine, hydroxylamine sulfate, sodium nitrobenzene sulfonate, sodium m-nitrobenzene sulfonate, and N-methylmorpholine N-oxide. The oxidizing agent is preferably present in the pretreatment coating composition at a level of from 10 to 10000 ppm, the most preferred levels are determined in part by their redox potential in that oxidizers with a higher redox potential can be used at lower levels. For example, hydrogen peroxide can be used at levels of from 10 to 30 ppm, whereas nitrate or sulfates are preferably used at levels of from 600 to 10000 ppm. Preferably the level of oxidizer agent used in the coating composition ranges in ppm upward from, in order of increasing preference, 10, 20, 30, 50, 100, 200, 300, 500, 800, 1100, 1400, 1700, 2000, 2300, 2600, 2900, 3200, 3500, 3800, 4100, 4400, 4700, 5000 and downward from, in order of increasing preference, 10000, 9700, 9400, 9100, 8800, 8500, 8200, 7900, 7600, 7300, 7000, 6700, 6400, 6100, 5800, 5500, 5200, 5000.

The pretreatment coating composition of the present invention also preferably includes fluorine (F) and optionally silicon dioxide ($SiO_2$) and copper (Cu). Preferably, the $SiO_2$ is present in the coating composition in ppm at levels of from 0 to 100, preferably ranging upward from, in order of increasing preference, 0, 10, 20, 30, 40, 50, 60 and downward from, in order of increasing preference, 100, 90, 80, 70, 60. The F is present both as total F and free F. The total F is preferably from 150 to 2000 ppm in the pretreatment coating composition and the free F is preferably from 10 to 100 ppm. Preferably the total F ranges in ppm upward from, in order of increasing preference, 150, 200, 300, 400, 500, 600, 700, 800, 900, 1000, 1100 and downward from, in order of increasing preference, 2000, 1900, 1800, 1700, 1600, 1500, 1400, 1300, 1200, 1100. Preferably the free F ranges in ppm upward from, in order of increasing preference, 10, 20, 30, 40, 50 and downward from, in order of increasing preference, 100, 90, 80, 70, 60, 50. The level of the optional Cu in the coating composition preferably ranges from 0 to 50 ppm, more preferably from 10 to 40 ppm.

In one embodiment the present invention is a metal pretreatment coating composition comprising the following: 50 to 300 parts per million (ppm) of zirconium, 0 to 50 ppm of copper, 0 to 100 ppm of $SiO_2$, 150 to 2000 ppm total fluorine, 10 to 100 ppm free fluorine, 150 to 10000 ppm zinc, and 10 to 10000 ppm of an oxidizing agent. The metal pretreatment coating composition more preferably comprises 75 to 300 ppm of zirconium, 0 to 40 ppm of copper and 20 to 100 ppm of $SiO_2$. The oxidizing agent of the metal pretreatment coating composition preferably comprises at least one of a nitrate ion or salt, a nitrite ion or salt, an inorganic peroxide, a permanganate ion or salt, a persulfate ion or salt, a perborate ion or salt, a chlorate ion or salt, a hypochlorite ion or salt, a vanadate ion or salt, a vanadyl ion or salt, a ceric ion or salt, a tungstate ion or salt, a stannic ion or salt, a hydroxylamine, a nitro-compound, an amine oxide, hydrogen peroxide, or a mixture thereof. The oxidizing agent preferably comprises at least one of ammonium nitrate, sodium nitrate, potassium nitrate, sodium nitrite, sodium peroxide, potassium permanganate, sodium persulfate, sodium perborate, sodium chlorate, sodium hypochlorite, sodium vanadate, vanadyl sulfate, ceric sulfate, ceric ammonium sulfate, ceric ammonium nitrate, sodium tungstate, stannic fluoride, hydroxylamine, hydroxylamine sulfate, sodium nitrobenzene sulfonate, sodium m-nitrobenzene sulfonate, and N-methylmorpholine N-oxide. In one preferred embodiment the oxidizing agent comprises an ion or salt of nitrate or sulfate present in an amount of from 600 to 10000 ppm. Alternatively, the oxidizing agent comprises hydrogen peroxide present in an amount of from 10 to 30 ppm.

In another embodiment, the present invention comprises a pretreatment coated metal substrate comprising: a pretreatment coating on a metal substrate wherein the pretreatment coating is derived from a pretreatment coating composition comprising: 50 to 300 parts per million (ppm) of zirconium, 0 to 50 ppm of copper, 0 to 100 ppm of $SiO_2$, 150 to 2000 ppm total fluorine, 10 to 100 ppm free fluorine, 150 to 10000 ppm zinc, and 10 to 10000 ppm of an oxidizing agent. More preferably the pretreatment coating is derived from a pretreatment coating composition further comprising: 75 to 300 ppm of zirconium, 0 to 40 ppm of copper and 20 to 100 ppm of $SiO_2$. The oxidizing agent preferably comprises at least one of a nitrate ion or salt, a nitrite ion or salt, an inorganic peroxide, a permanganate ion or salt, a persulfate ion or salt, a perborate ion or salt, a chlorate ion or salt, a hypochlorite ion or salt, a vanadate ion or salt, a vanadyl ion or salt, a ceric ion or salt, a tungstate ion or salt, a stannic ion or salt, a hydroxylamine, a nitro-compound, an amine oxide, hydrogen peroxide, or a mixture thereof. More preferably, the oxidizing agent comprises at least one of ammonium nitrate, sodium nitrate, potassium nitrate, sodium nitrite, sodium peroxide, potassium permanganate, sodium persulfate, sodium perborate, sodium chlorate, sodium hypochlorite, sodium vanadate, vanadyl sulfate, ceric sulfate, ceric ammonium sulfate, ceric ammonium nitrate, sodium tungstate, stannic fluoride, hydroxylamine, hydroxylamine sulfate, sodium nitrobenzene sulfonate, sodium m-nitrobenzene sulfonate, and N-methylmorpholine N-oxide. In an embodiment the oxidizing agent comprises an ion or salt of nitrate or sulfate present in an amount of from 600 to 10000 ppm and in another it comprises hydrogen peroxide present in an amount of from 10 to 30 ppm. Preferably, the metal substrate comprises at least one of cold rolled steel (CRS), hot-rolled steel, stainless steel, steel coated with zinc metal, a zinc alloy, electrogalvanized steel (EG), galvalume, galvanneal, hot-dipped galvanized steel (HDG), an aluminum alloy and an aluminum. The pretreatment coated metal substrate can further comprise an electrocoating layer having a thickness of from 0.7 to 1.2 mils on top of the pretreatment coating. In addition, the electrocoated coated metal substrate can further comprise a topcoat layer on top of said electrocoating layer.

In another embodiment the present invention comprises a method of coating a metal substrate with a pretreatment coating comprising the steps of: exposing a metal substrate to a pretreatment coating composition comprising 50 to 300 parts per million (ppm) of zirconium, 0 to 50 ppm of copper, 0 to 100 ppm of $SiO_2$, 150 to 2000 ppm total fluorine, 10 to 100 ppm free fluorine, 150 to 10000 ppm zinc, and 10 to 10000 ppm of an oxidizing agent. Preferably the pretreatment coating composition comprises 75 to 300 ppm of zirconium, 0 to 40 ppm of copper, 20 to 100 ppm of $SiO_2$. The metal substrate can comprise at least one of cold rolled steel (CRS), hot-rolled steel, stainless steel, steel coated with zinc metal, a zinc alloy, electrogalvanized steel (EG), galvalume, galvanneal, hot-dipped galvanized steel (HDG), an aluminum alloy and an aluminum. The oxidizing agent can comprise at least one of a nitrate ion or salt, a nitrite ion or salt, an inorganic peroxide, a permanganate ion or salt, a persulfate ion or salt, a perborate ion or salt, a chlorate ion or salt, a hypochlorite ion or salt, a vanadate ion or salt, a vanadyl ion or salt, a ceric ion or salt, a tungstate ion or salt, a stannic ion or salt, a hydroxylamine, a nitro-compound, an amine oxide, hydrogen peroxide, or a mixture thereof.

Preferably, the oxidizing agent is at least one of ammonium nitrate, sodium nitrate, potassium nitrate, sodium nitrite, sodium peroxide, potassium permanganate, sodium persulfate, sodium perborate, sodium chlorate, sodium hypochlorite, sodium vanadate, vanadyl sulfate, ceric sulfate, ceric ammonium sulfate, ceric ammonium nitrate, sodium tungstate, stannic fluoride, hydroxylamine, hydroxylamine sulfate, sodium nitrobenzene sulfonate, sodium m-nitrobenzene sulfonate, and N-methylmorpholine N-oxide. In an embodiment the oxidizing agent comprises an ion or salt of nitrate or sulfate present in an amount of from 600 to 10000 ppm or hydrogen peroxide present in an amount of from 10 to 30 ppm. The metal substrate can be exposed to the pretreatment by at least one of spraying, immersion bath, or a mixture thereof for periods of time ranging from 60 to 120 seconds for each exposure. After the pretreatment coating has been applied an electrocoating layer can be applied on top of the pretreatment coating. The electrocoating layer can be followed by applying a topcoating layer over the electrocoating layer.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout this description, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed; specification of materials in ionic form additionally implies the presence of sufficient counter ions to produce electrical neutrality for the composition as a whole (any counter ions thus implicitly specified should preferably be selected from among other constituents explicitly specified in ionic form, to the extent possible; otherwise such counter ions may be freely selected, except for avoiding counter ions that act adversely to the objects of the invention).

These and other features and advantages of this invention will become more apparent to those skilled in the art from the detailed description of a preferred embodiment.

DETAILED DESCRIPTION

The present invention is directed toward improved conversion pretreatment coating compositions for coating a variety of metal substrates to provide corrosion resistance to the substrates. In particular the metal substrates that can be passivated, provided with enhanced corrosion resistance, by the pretreatment coating compositions of the invention include cold rolled steel (CRS), hot-rolled steel, stainless steel, steel coated with zinc metal, zinc alloys such as electrogalvanized steel (EG), galvalume, galvanneal (HIA), and hot-dipped galvanized steel (HDG), aluminum alloys such as AL6111 and aluminum plated steel substrates. The invention also offers the advantage that components containing more than one type of metal substrate can be passivated in a single process because of the broad range of metal substrates that can be passivated by the pretreatment coating compositions of the invention.

The inventive pretreatment is zirconium based and thus is cleaner than phosphate based pretreatments. It can be substituted in a normal pretreatment process without significant changes to the process. Preferably the pretreatment coating composition comprises: 50 to 300 ppm of zirconium, 0 to 100 ppm of $SiO_2$, 0 to 50 ppm of copper, 150 to 2000 ppm of total fluorine, 10 to 100 ppm of free fluorine, 150 to 10000 ppm of zinc and 10 to 10000 ppm of an oxidizing agent. The pretreatment coating composition has an acidic pH of preferably 3.0 to 5.0, more preferably from 3.5 to 4.5. The oxidizer agent can include oxidizing ions and salts thereof and may include a mixture of oxidizing agents. Especially preferred in the present invention is use of nitrate salts and ions as the oxidizing agent. Examples of suitable nitrates include ammonium nitrate, sodium nitrate and potassium nitrate. Other oxidizing agents, as ions or salts, that are expected to be able to replace or enhance the function of the nitrate ion include: nitrite ion, inorganic peroxides, permanganate ion, persulfate ion, perborate ion, chlorate ion, hypochlorite ion, vanadate ion, vanadyl ion, ceric ion, tungstate ion, stannic ion, hydroxylamines $R_2$—NOH, nitro-compounds R—$NO_2$, amine oxides $R_3$—NO and hydrogen peroxide. Examples of useful sources of these include: sodium nitrite, sodium peroxide, potassium permanganate, sodium persulfate, sodium perborate, sodium chlorate, sodium hypochlorite, sodium vanadate, vanadyl sulfate, ceric sulfate, ceric ammonium sulfate, ceric ammonium nitrate, sodium tungstate, stannic fluoride, hydroxylamine, hydroxylamine sulfate, sodium nitrobenzene sulfonate, sodium m-nitrobenzene sulfonate, and N-methylmorpholine N-oxide. The oxidizing agent is preferably present in the pretreatment coating composition at a level of from 10 to 10000 ppm, the most preferred levels are determined in part by their redox potential in that oxidizers with a higher redox potential can be used at lower levels. For example, hydrogen peroxide can be used at levels of from 10 to 30 ppm, whereas nitrate or sulfates are preferably used at levels of from 600 to 10000 ppm.

The pretreatment coating composition can be used in the standard processes for metal pretreatment. These generally involve an initial cleaning of the metal substrate with an acidic or alkaline cleaner. Examples include the Parco® Cleaners such as 1533 or 1523 which are typically applied via spray, immersion bath or both for 60 to 120 seconds at about 50° C. per the manufacture's directions. Other alkaline or acidic metal cleaners are also expected to work in the present invention. The cleaning step is generally followed by several warm water rinses with city water and deionized water. After these rinses the pretreatment coating of the present invention is applied via spray, immersion bath or both for a period of time generally ranging from 60 to 120 seconds. Typically, the exposure occurs at temperatures of about 25° C. After exposure to the pretreatment coating composition the substrate is generally again rinsed with warm deionized water and blown dry. After the pretreatment coating in the industry the substrates are often covered in an electrocoating and then painted with a topcoat. The electrocoatings are available from many sources and often include a post application baking step to dry the film in place. The typical electrocoating film thicknesses are from about 0.7 to 1.2 mils in thickness. After the electrocoating the substrates are often painted with a topcoating system. These systems typically include a primer coating, a paint basecoat and then a clearcoat. Typical dry film thicknesses for these topcoats are from 0.9 to 1.3 mils dry film thickness.

Substrates coated with the pretreatment coating of the present invention alone or after electrocoating and perhaps topcoating are typically tested for corrosion resistance in standardized testing protocols. The substrates with coatings are scribed down to the substrate level and then exposed to various humidity levels, temperatures and salt sprays. Often the pretreatment coatings are tested for their effects on paint adhesion to the substrates. In this testing the substrate is first cleaned and coated with the pretreatment coating. Then an electrocoating is applied followed by a topcoating. The panels are then subjected to mechanical stresses such as being stored at very low temperatures well below freezing and then having gravel flung at it at high pressure to simulate road debris. The amount of paint chipping and other damage is then observed. The goal is to develop pretreatment coating compositions that enhance corrosion resistance and paint adhesion to a variety of substrates.

A new pretreatment designed in accordance with the present invention will result in enhanced corrosion protection, enhanced paint adhesion of subsequently applied electrocoatings and topcoatings and lower zirconium incorporation than past pretreatments. The pretreatment according to the present invention has as important elements the presence of zinc and an oxidizing agent. The oxidizing agent can be selected from a large group including nitrate salts and ions as the oxidizing agent. Examples of nitrates include ammonium nitrate, sodium nitrate and potassium nitrate. Other oxidizing agents, as ions or salts, that can replace the function of the nitrate ion include: nitrite ion, inorganic peroxides, permanganate ion, persulfate ion, perborate ion, chlorate ion, hypochlorite ion, vanadate ion, vanadyl ion, ceric ion, tungstate ion, stannic ion, hydroxylamines $R_2$—NOH, nitro-compounds R—$NO_2$, amine oxides $R_3$—NO and hydrogen peroxide. Examples of useful sources of these include: sodium nitrite, sodium peroxide, potassium permanganate, sodium persulfate, sodium perborate, sodium chlorate, sodium hypochlorite, sodium vanadate, vanadyl sulfate, ceric sulfate, ceric ammonium sulfate, ceric ammonium nitrate, sodium tungstate, stannic fluoride, hydroxylamine, hydroxylamine sulfate, sodium nitrobenzene sulfonate, sodium m-nitrobenzene sulfonate, and N-methylmorpholine N-oxide. The oxidizing agent is preferably present in the pretreatment coating composition at a level of from 10 to 10000 ppm, the most preferred levels are determined in part by their redox potential in that oxidizers with a higher redox potential can be used at lower levels. For example, hydrogen peroxide can be used at levels of from 10 to 30 ppm, whereas nitrate is preferably used at levels of from 600 to 10000 ppm. The oxidizing agents can be used alone or in combination with each other. Of course, it will be understood that the coating composition of the present invention can be provided as a concentrated composition that is diluted with water prior to use to produce the recited levels of the components.

The pretreatment coating composition of the present invention finds use as a pretreatment coating for a wide range of metal substrates and provides enhanced corrosion resistance to the substrates and enhanced paint adhesion. The treated metal substrates are used in many products including automotive, aeronautics, appliance and other manufacturing industries. Preferably when diluted to usage levels the pretreatment coating composition according to the present invention has the composition detailed below in TABLE 1.

TABLE 1

| | Zr, ppm | Cu, ppm | $SiO_2$, ppm | F, total ppm | F, free ppm | Zn, ppm | Oxidizer ppm | pH |
|---|---|---|---|---|---|---|---|---|
| Using nitrate oxidizer | 50-300 | 0-50 | 0-100 | 150-2000 | 10-100 | 150-10000 | 600-10000 | 4.00 |
| Using sulfate oxidizer | 50-300 | 0-50 | 0-100 | 150-2000 | 10-100 | 150-10000 | 600-10000 | 4.00 |
| Using other oxidizers | 50-300 | 0-50 | 0-100 | 150-2000 | 10-100 | 150-10000 | 10-10000 | 4.00 |

Surprisingly, the present invention provides for enhanced corrosion protection and improved paint adhesion despite resulting in much thinner pretreatments coating layers than the prior systems.

EXAMPLES

The standard pretreatment coating process for all of the data, unless otherwise noted, was as described below in TABLE 2 using the pretreatment coating compositions. The Parco® Cleaner 1533 is an alkaline cleaner available from Henkel Adhesive Technologies. The control pretreatment coating composition was a zirconium based pretreatment coating composition with no zinc and a very low level of $NO_3$.

TABLE 2

| Stage | Treatment | Product | Application | Time, seconds | Temperature ° C. |
|---|---|---|---|---|---|
| 1 | Clean | Parco ® Cleaner 1533 | Spray | 120 | 50 |
| 2 | Rinse | Water | Spray | 60 | 38 |
| 3 | Rinse | Deionized water | Spray | 60 | 25 |
| 4 | Pre-treatment | Test pretreatment solution | Immersion | 120 | 25 |
| 5 | Rinse | Deionized water | Spray | 60 | 25 |

In a first series of experiments a control pretreatment coating composition with no zinc and a very low level of nitrate was supplemented with various levels of zinc and nitrate, and applied to a variety of substrates. The pretreatment coating compositions are detailed below in TABLE 3. Pretreatment example 1 is the control pretreatment coating composition. Pretreatments 2 to 5 have increasing amounts of zinc and nitrate added to them.

TABLE 3

| Pretreatment example | Zr, ppm | Cu, ppm | $SiO_2$, ppm | F, total ppm | F, free ppm | Zn, ppm | $NO_3$, ppm | pH |
|---|---|---|---|---|---|---|---|---|
| 1 control | 150 | 20 | 50 | 360 | 35 | 0 | 100 | 4.00 |
| 2 | 150 | 20 | 50 | 360 | 35 | 600 | 1600 | 4.00 |
| 3 | 150 | 20 | 50 | 360 | 35 | 1200 | 3000 | 4.00 |
| 4 | 150 | 20 | 50 | 360 | 35 | 1800 | 4200 | 4.00 |
| 5 | 150 | 20 | 50 | 360 | 35 | 2400 | 5500 | 4.00 |

The pretreatments were applied, as described above, to the following substrates: cold rolled steel (CRS); electrogalvanized steel (EG); hot-dipped galvanized steel (HDG); galvanneal steel (HIA); and the aluminum alloy AL6111. As an initial measure the zirconium coating weight in milligrams per meter squared on each substrate was determined by X-ray fluorescence and the results are presented below in TABLE 4. In general, as the levels of zinc and nitrate increased the zirconium coating weight was reduced on all of the tested substrates.

TABLE 4

| | Zirconium Coating Weight, mg/m$^2$ | | | | |
|---|---|---|---|---|---|
| Pretreatment | CRS | EG | HDG | HIA | AL6111 |
| 1 control | 130 | 290 | 240 | 230 | 50 |
| 2 | 100 | 230 | 200 | 210 | 50 |
| 3 | 50 | 150 | 110 | 120 | 30 |
| 4 | 60 | 170 | 120 | 120 | 40 |
| 5 | 60 | 150 | 90 | 130 | 30 |

In a next series of experiments another control pretreatment coating, Bonderite® 958 (B-958), was also incorporated so that the performance of the pretreatments of the present invention could also be compared to an industry standard zinc phosphate based pretreatment, B-958. All of the samples were pretreated as described in TABLE 2 above except for the Bonderite® 958 sample, which was treated per the manufacture's instructions. The pretreated samples were then coated with cathodic electrocoat primer, scribed to substrate level and then placed in corrosion testing as described below. The electrocoating was with BASF electrocoat CathoGuard® 310X with an application time of 2 minutes at a temperature of 90° F. (32.2° C.) and an application voltage of 230 Volts. The samples were baked at 320° F. (160.0° C.) for 20 minutes and resulted in a dry film thickness of 0.8 to 1.1 mils. Panels of each pretreatment after electrocoating were subjected to 40 continuous corrosion cycles that were 24 hours each as described below. A pH 6 to 9 salt mist spray comprising 0.9% by weight sodium chloride, 0.1% by weight calcium chloride, and 0.25% by weight sodium bicarbonate was prepared. The test panels were placed in an environment of 25° C. and 40 to 50% relative humidity (RH). Over the first 8 hours the panels were misted with the salt mist spray at time 0, 1.5 hours, 3 hours, and at 4.5 hours. After the first 8 hours the panels were subjected to 49° C. and 100% RH with a ramp up from 25° C. and 40 to 50% RH over the first hour. The panels showed visible water droplets on them. The last 8 hours of the 24 hour cycle was to ramp up to 60° C. and down to less than 30% RH over a 3 hour period and then hold these conditions for another 5 hours. This completed one 24 hour cycle and the panels were subjected to 40 total cycles. The panels were evaluated for average corrosion creep from the scribe line and maximum corrosion creep from the scribe line in millimeters. The results are presented below in TABLE 5A and 5B.

TABLE 5A

| Pre-treatment | CRS, average creep mm | CRS maximum creep mm | EG average creep mm | EG maximum creep mm | HDG average creep mm | HDG maximum creep mm |
|---|---|---|---|---|---|---|
| B-958 control | 2.8 | 3.8 | 1.0 | 1.7 | 0.7 | 1.6 |
| 1 control | 3.7 | 7.2 | 1.0 | 2.0 | 1.0 | 2.4 |
| 2 | 4.8 | 6.6 | 1.5 | 3.0 | 1.2 | 2.8 |
| 3 | 3.6 | 6.3 | 0.9 | 3.0 | 0.6 | 0.8 |

TABLE 5A-continued

| Pre-treatment | CRS, average creep mm | CRS maximum creep mm | EG average creep mm | EG maximum creep mm | HDG average creep mm | HDG maximum creep mm |
|---|---|---|---|---|---|---|
| 4 | 2.9 | 5.0 | 0.9 | 2.0 | 0.6 | 1.7 |
| 5 | 2.6 | 3.8 | 1.1 | 2.1 | 0.9 | 2.0 |

TABLE 5B

| Pretreatment | HIA average creep mm | HIA maximum creep mm | AL6111 average creep mm | AL6111 maximum creep mm |
|---|---|---|---|---|
| B-958 control | 0.9 | 1.5 | 0.5 | 0.6 |
| 1 control | 0.9 | 1.5 | 0.5 | 0.5 |
| 2 | 0.7 | 1.3 | 0.6 | 0.7 |
| 3 | 0.9 | 1.3 | 0.6 | 0.7 |
| 4 | 0.7 | 0.8 | 0.5 | 0.5 |
| 5 | 0.7 | 0.9 | 0.5 | 0.5 |

The results show that the pretreatments according to the present invention show improved anti-corrosion performance on CRS, HDG, HIA, and AL6111 substrates, but no real change on EG. In some cases, the pretreatments of the present invention performed as well as B-958 and increasing levels of zinc and nitrate seemed to perform better.

In a next series of tests panels coated with the pretreatments were then finish coated with BASF Topcoat system to produce panels having a pretreatment, electrocoat, primer, base paint coat, and clear coat. The BASF Topcoat system comprised a primer of PUA1177C powder, a basecoat of R98WU321S, a clearcoat of R10CG060S and produced a total film thickness of 5.0 to 8.0 mils, and a basecoat thickness of 1.0 to 1.2 mils. The panels were then tested for their resistance to paint chipping using a gravelometer as known in the industry. The basic protocol was as follows: the 100 by 300 millimeter test panels were placed at −30° C. for 4 hours; then put into a gravelometer and 1 pint of gravel having a size such that it fell through a 16 millimeter screen and was retained on a 9.5 millimeter space screen was thrown at it using an air pressure of 70 pounds per square inch (0.48263 mega Pascal). The panel was removed, dust and condensation moisture were wiped off of the panel. The panel was then covered with a 100 millimeter strip of masking tape, pressed firmly and then the tape was removed to pull off loose chips and paint. The panels were then visually examined and the extent of chip damage compared to photographic standards. The damage was rated from 0 to 10 with 0 being failure and extensive chip damage and 10 being no visible chip damage. In addition, the average chip diameter was determined in millimeters. The results are presented below in TABLE 6A and 6B. The pretreatments of the present invention performed very well on the chip testing. The present invention pretreatments performed better than the control pretreatment and at the highest levels of zinc and nitrate they performed as well as the industry standard B-958. This data shows that for many substrates the pretreatments of the present invention improve paint adhesion compared to a control pretreatment.

TABLE 6A

| Pretreatment | CRS damage rating | CRS average chip diameter mm | EG damage rating | EG average chip diameter mm | HDG damage rating | HDG average chip diameter mm |
|---|---|---|---|---|---|---|
| B-958 control | 9 | 2 | 9 | 4 | 9 | 2 |
| 1 control | 7 | 5 | 8 | 4 | 8 | 4 |
| 2 | 7 | 5 | 9 | 2 | 9 | 2 |
| 3 | 8 | 4 | 9 | 3 | 9 | 3 |
| 4 | 9 | 2 | 9 | 3 | 9 | 3 |
| 5 | 9 | 2 | 9 | 2 | 9 | 3 |

TABLE 6B

| Pretreatment | HIA damage rating | HIA average chip diameter mm | AL6111 damage rating | AL6111 average chip diameter mm |
|---|---|---|---|---|
| B-958 control | 9 | 3 | 10 | 0 |
| 1 control | 9 | 3 | 10 | 0 |
| 2 | 9 | 3 | 10 | 0 |
| 3 | 9 | 3 | 10 | 0 |
| 4 | 9 | 3 | 10 | 0 |
| 5 | 9 | 2 | 10 | 0 |

For the next series of experiments another series of pretreatment compositions were prepared as detailed below in TABLE 7. The pretreatments were then applied to CRS and the zirconium coating weight in milligrams per meter squared was determined. In addition, the coating thicknesses in nanometers (nm) and atomic percentages (At %) of several key elements in the coatings were determined by X-ray photoelectron spectroscopy for several of the coatings. These results are presented below in TABLE 8.

TABLE 7

| Pretreatment example | Zr, ppm | Cu, ppm | $SiO_2$, ppm | F, total ppm | F, free ppm | Zn, ppm | $NO_3$, ppm | pH |
|---|---|---|---|---|---|---|---|---|
| 6 control | 150 | 20 | 50 | 200 | 15 | 0 | 100 | 4.00 |
| 7 | 150 | 20 | 50 | 400 | 35 | 600 | 1600 | 4.00 |
| 8 | 150 | 20 | 50 | 500 | 35 | 1200 | 3000 | 4.00 |
| 9 | 150 | 20 | 50 | 500 | 35 | 1800 | 4200 | 4.00 |
| 10 | 150 | 20 | 50 | 500 | 35 | 2400 | 5500 | 4.00 |
| 11 | 150 | 20 | 50 | 500 | 35 | 3000 | 6800 | 4.00 |

TABLE 8

| Pretreatment | Zr wt ($mg/m^2$) | Coating thickness, nm | Zr At % | Fe At % | Cu At % | Zn At % |
|---|---|---|---|---|---|---|
| 6 control | 101 | 65 | 24 | 12 | 8 | 0 |
| 7 | 83 | 50 | 20 | 16 | 9 | 0.5 |
| 8 | 54 | 45 | 16 | 18 | 10 | 1.5 |
| 9 | 45 | | | | | |
| 10 | 30 | | | | | |
| 11 | 18 | | | | | |

The data show several interesting trends. As demonstrated above as the levels of zinc and nitrate increase the coating weight of zirconium goes down. The data also shows that the levels of zinc and nitrate also affect coating thickness and atomic make up. The increasing levels of zinc and nitrate decrease the coating thickness. Increasing levels of zinc and nitrate also result in less zirconium in the coating as shown before but also more iron and more copper. In addition, there is some incorporation of zinc into the coating.

In the next series of tests, the coatings from TABLE 7 or B-958 were applied to CRS panels and the panels were subjected to a variety of corrosion testing protocols after being scribed. In a 30 cycle test the panels were subjected to 30 cycles of a 24 hour testing protocol similar to that described above. The salt misting spray comprised 0.9% by weight sodium chloride, 0.1% by weight calcium chloride, and 0.075% by weight sodium bicarbonate. The first 8 hours the panels were kept at 25° C. and 45% RH and misted 4 times during the 8 hours as described above. The panels were then put at 49° C. and 100% RH for the next 8 hours. The final 8 hours were at 60° C. and less than 30% RH. The cycle was carried out for a total of 30 times. The panels were then evaluated for average corrosion creep and maximum corrosion creep in millimeters from the scribe. The panels were also tested for 500 or 1000 hours using ASTM B117 protocol. The results are presented below in TABLE 9. The results demonstrate that the pretreatments prepared according to the present invention perform better in cyclic corrosion testing than the control pretreatment.

TABLE 9

| Pre-treatment | 30 cycle average creep mm | 30 cycle maximum creep mm | ASTM B117 500 hr average creep mm | ASTM B117 500 hr maximum creep mm | ASTM B117 1000 hr average creep mm | ASTM B117 1000 hr maximum creep mm |
|---|---|---|---|---|---|---|
| B-958 control | 2.5 | 3.6 | 1.7 | 2.6 | 2.6 | 3.4 |
| 6 control | 6.5 | 8.3 | 4.9 | 7.6 | 15.6 | 26.7 |
| 7 | 4.8 | 5.3 | 1.7 | 2.7 | 4.1 | 6.7 |
| 8 | 4.5 | 5.6 | 1.5 | 2.2 | 4.2 | 6.8 |
| 9 | 3.9 | 5.0 | 1.7 | 2.4 | 5.4 | 8.4 |
| 10 | 3.7 | 4.4 | 1.7 | 2.1 | 4.0 | 5.9 |
| 11 | 3.5 | 4.1 | 1.6 | 2.0 | 3.8 | 5.6 |

Several of these pretreatments were also tested in a gravelometer test. For these tests the CRS panels with pretreatment applied were then covered with either the BASF Topcoat system as described above or the DuPont Topcoat system. The DuPont Topcoat system used primer 765224EH, basecoat 270AC301, clearcoat RK8148 and produced a dry total film thickness of 5.0 to 8.0 mils, and a dry basecoat thickness of 1.0 to 1.2 mils. The panels were subjected to the gravelometer test and the number of chips in a 4 inch by 6 inch (10.2 cm by 15.2 cm) section of each panel were determined. In addition, the average chip diameter in millimeters was determined. The results are shown below in TABLE 10. The pretreatments according to the present invention were significantly better than the control pretreatment. The number of chips was significantly lower and the chips were smaller with pretreatments according to the present invention. As the amount of zinc and nitrate were increased the pretreatment was more effective.

TABLE 10

| Pretreatment | DuPont number of chips | DuPont average chip diameter mm | BASF number of chips | BASF average chip diameter mm |
|---|---|---|---|---|
| B-958 control | 5 | 1.7 | 8 | 1.6 |
| 6 control | 12 | 2.2 | 9 | 1.8 |

TABLE 10-continued

| Pretreatment | DuPont number of chips | DuPont average chip diameter mm | BASF number of chips | BASF average chip diameter mm |
|---|---|---|---|---|
| 7 | 10 | 1.7 | 7 | 1.9 |
| 8 | 6 | 1.6 | 6 | 1.8 |

In the next series of experiments the nitrate was replaced with sulfate as the counter ion to determine if this counter ion can replace nitrate. The pretreatment compositions are presented below in TABLE 11. The pretreatments were applied to CRS panels and several parameters were measured. The zirconium coating weight in milligrams per meter squared was determined and reported in TABLE 12 below. Also, the 30 cycle corrosion testing as reported in TABLE 9 above was performed in the panels except the panels were run for 31 cycles instead of 30. The results are presented below in TABLE 12 in terms of average corrosion creep from scribe and maximum corrosion creep from scribe in millimeters.

TABLE 11

| Pretreatment example | Zr, ppm | Cu, ppm | $SiO_2$, ppm | F, total ppm | F, free ppm | Zn, ppm | $SO_4$, ppm | pH |
|---|---|---|---|---|---|---|---|---|
| 12 control | 150 | 20 | 50 | 200 | 15 | 0 | 0 | 4.00 |
| 13 | 150 | 20 | 50 | 400 | 35 | 600 | 900 | 4.00 |
| 14 | 150 | 20 | 50 | 400 | 35 | 1200 | 1800 | 4.00 |
| 15 | 150 | 20 | 50 | 400 | 35 | 1800 | 2600 | 4.00 |
| 16 | 150 | 20 | 50 | 400 | 35 | 2400 | 3500 | 4.00 |
| 17 | 150 | 20 | 50 | 400 | 35 | 4800 | 7000 | 4.00 |

TABLE 12

| Pretreatment | Zr $mg/m^2$ | Average creep mm | Maximum creep mm |
|---|---|---|---|
| B-958 control | | 3.0 | 3.4 |
| 12 control | 94 | 5.8 | 8.0 |
| 13 | 70 | 6.4 | 9.5 |
| 14 | 71 | 4.5 | 6.7 |
| 15 | 76 | 4.5 | 6.1 |
| 16 | 75 | 4.9 | 6.5 |
| 17 | 65 | 4.0 | 4.9 |

The results demonstrate that sulfate also functions with zinc to reduce zirconium coating weight, although not to the same extent as nitrate. The data also demonstrate that the sulfate and zinc combination is effective in enhancing the corrosion resistance of the pretreatment such that it is almost as effective as the standard B-958.

In the next series the effect of nitrate alone in the absence of zinc was tested in a series of pretreatments as detailed below in TABLE 13. The pretreatments were applied to CRS panels and tested as described above for 31 cycles and the average and maximum creep from scribe were determined and reported below in TABLE 14. The results demonstrate that higher levels of nitrate alone have the ability to also enhance the corrosion protective effect of zirconium based pretreatment coatings, although to a lesser extent than zinc.

TABLE 13

| Pre-treatment example | Zr, ppm | Cu, ppm | $SiO_2$, ppm | F, total ppm | F, free ppm | Zn, ppm | $NH_4$, ppm | $NO_3$, ppm | pH |
|---|---|---|---|---|---|---|---|---|---|
| 18 control | 150 | 20 | 50 | 200 | 15 | 0 | 100 | 0 | 4.00 |
| 19 | 150 | 20 | 50 | 400 | 35 | 0 | 600 | 1500 | 4.00 |
| 20 | 150 | 20 | 50 | 400 | 35 | 0 | 1000 | 3000 | 4.00 |
| 21 | 150 | 20 | 50 | 400 | 35 | 0 | 1800 | 6000 | 4.00 |

TABLE 14

| Example | Average Creep, mm | Maximum Creep, mm |
|---|---|---|
| B-958 Control | 3.0 | 3.4 |
| 18 control | 5.8 | 8.0 |
| 19 | 6.1 | 9.6 |
| 20 | 4.8 | 7.7 |
| 21 | 3.8 | 5.5 |

In the next series of experiments another set of pretreatment compositions was prepared as detailed below in TABLE 15. The compositions were applied to CRS and then tested for corrosion resistance via the 30 cycle procedure described above. The results are presented in TABLE 16 below. The results demonstrated the effects of increasing zinc and nitrate. In general, increasing the zinc at a constant nitrate level enhanced corrosion performance and increasing the nitrate at a constant zinc level also did so.

TABLE 15

| Pretreatment example | Zr, ppm | Cu, ppm | $SiO_2$, ppm | F, total ppm | F, free ppm | Zn, ppm | $NO_3$, ppm | pH |
|---|---|---|---|---|---|---|---|---|
| 22 | 150 | 15 | 50 | 200 | 35 | 0 | 1000 | 4.00 |
| 23 | 150 | 15 | 50 | 285 | 35 | 150 | 1000 | 4.00 |
| 24 | 150 | 15 | 50 | 550 | 35 | 600 | 1000 | 4.00 |
| 25 | 150 | 15 | 50 | 1600 | 35 | 2400 | 1000 | 4.00 |
| 26 | 150 | 15 | 50 | 200 | 35 | 0 | 6000 | 4.00 |
| 27 | 150 | 15 | 50 | 285 | 35 | 150 | 6000 | 4.00 |
| 28 | 150 | 15 | 50 | 550 | 35 | 600 | 6000 | 4.00 |
| 29 | 150 | 15 | 50 | 1600 | 35 | 2400 | 6000 | 4.00 |
| 30 | 150 | 15 | 50 | 200 | 35 | 0 | 10000 | 4.00 |
| 31 | 150 | 15 | 50 | 285 | 35 | 150 | 10000 | 4.00 |
| 32 | 150 | 15 | 50 | 550 | 35 | 600 | 10000 | 4.00 |
| 33 | 150 | 15 | 50 | 1600 | 35 | 2400 | 10000 | 4.00 |

TABLE 16

| Pretreatment example | Average Creep, mm | Maximum Creep, mm |
|---|---|---|
| B-958 Control | 3.5 | 5.4 |
| 22 | 7.4 | 10.6 |
| 23 | 5.3 | 8.1 |
| 24 | 6.4 | 9.7 |
| 25 | 5.1 | 7.4 |
| 26 | 6.1 | 9.0 |
| 27 | 3.6 | 5.0 |
| 28 | 5.5 | 7.1 |
| 29 | 4.8 | 7.5 |
| 30 | 5.9 | 9.0 |
| 31 | 5.2 | 7.2 |
| 32 | 5.2 | 6.9 |
| 33 | 4.5 | 7.2 |

In another series of tests, the pretreatments described below in TABLE 17 were applied to CRS panels. The coating weigh of zirconium was determined and reported below in TABLE 18. Panels were also further treated to electrodeposition with DuPont electrocoat 21 and DuPont "3 wet" Topcoat. The coated panels were then subjected to the 30 cycle corrosion test described above and the results are presented below in TABLE 18. Again, the presence of zinc and nitrate enhanced corrosion protection of the pretreatment.

TABLE 17

| | Zr, ppm | Cu, ppm | $SiO_2$, ppm | F, total ppm | F, free ppm | Zn, ppm | $NO_3$, ppm | pH |
|---|---|---|---|---|---|---|---|---|
| 34 control | 150 | 5 | 50 | 200 | 15 | 0 | 100 | 4.00 |
| 35 | 150 | 5 | 50 | 200 | 15 | 600 | 1600 | 4.00 |
| 36 | 150 | 5 | 50 | 200 | 15 | 1800 | 4200 | 4.00 |

TABLE 18

| Pretreatment | Zirconium coating weight $mg/m^2$ | Maximum creep mm |
|---|---|---|
| B-958 control | | 9.8 |
| 34 control | 60 | 6.8 |
| 35 | 67 | 5.1 |
| 36 | 64 | 6.2 |

In another series of experiments the treatment protocol was changed as shown below in TABLE 19 using the pretreatments described in TABLE 20 on ACT CRS panels. The control pretreatment B-958 was also included. The zirconium coating weights in $mg/m^2$ were determined and are reported below in TABLE 21. A multiple of panels for each condition were then coated with a BASF electrocoat of CathoGuard® 800 and a BASF Topcoat system as described below. The application time of the CathoGuard® 800 was 2 minutes at 92° F. (33.3° C.) with an application voltage of 250 Volts. The bake time was 20 minutes at 350° F. (176.7° C.). The dry film thickness of CathoGuard® 800 was 0.8 to 1.1 mils. The BASF Topcoat system was a primer of R28WW216F, a basecoat of R98WW321, and a clearcoat of R10CG060B which produced a total dry film thickness on the substrate of 5.0 to 8.0 mils. The samples were then tested for corrosion resistance as described above for samples 6-11 except the exposure was for 28 cycles. The corrosion results are reported below in TABLE 22. The results again show that the pretreatment according to the present invention reduced the zirconium coating weight and enhanced the corrosion resistance of panels using another electrocoating and topcoat system.

TABLE 19

| Stage | Treatment | Product | Application | Application time (sec) | Application temp. (° C.) |
|---|---|---|---|---|---|
| 1 | Clean | Parco ® Cleaner 1523 | Spray | 60 | 50 |
| 2 | Clean | Parco ® Cleaner 1523 | Immersion | 120 | 50 |
| 3 | Rinse | City water | Spray | 60 | 38 |
| 4 | Rinse | Deionized water | Spray | 60 | 25 |
| 5 | Pre-treatment | Pretreatment | Immersion | 120 | 25 |
| 6 | Rinse | Deionized water | Spray | 60 | 25 |

TABLE 20

| Pretreatment example | Zr ppm | Cu ppm | $SiO_2$ ppm | F total ppm | F free ppm | Zn ppm | $NO_3$ ppm | pH |
|---|---|---|---|---|---|---|---|---|
| 37 control | 150 | 10 | 50 | 200 | 35 | 0 | 100 | 4.00 |
| 38 | 150 | 10 | 50 | 200 | 35 | 600 | 6000 | 4.00 |

TABLE 21

| Pretreatment example | Zr coating weight $mg/m^2$ |
|---|---|
| 37 control | 70 |
| 38 | 87 |

TABLE 22

| Pretreatment example | Maximum creep mm |
|---|---|
| B-958 | 5.6 |
| 37 control | 11.5 |
| 38 | 6.5 |

In a final series of examples, the effect of including the oxidizing agent hydrogen peroxide in the present invention was tested. The treatment protocol was changed as shown below in TABLE 23 using the pretreatments described in TABLE 24 on ACT CRS panels. The control pretreatment B-958 was also included. The zirconium coating weights in $mg/m^2$ were determined and are reported below in TABLE 25. A multiple of panels for each condition were then coated with a BASF electrocoat of CathoGuard® 310X as described above for examples 1-5. The dry film CathoGuard® 310X thickness was 0.8 to 1.1 mils. The samples were then tested for corrosion resistance as described above for samples 6-11 except the exposure was for 31 cycles. The corrosion results are reported below in TABLE 26. The results show that hydrogen peroxide alone reduced the zirconium coating weight, reduced the average and maximum corrosion creep. The results further show that when hydrogen peroxide is combined with the elevated zinc and elevated nitrate the pretreatment coating compositions of the present invention were even more effective in reducing average and maximum corrosion creep.

TABLE 23

| Stage | Treatment | Product | Application method | Application time seconds | Application temperature ° C. |
|---|---|---|---|---|---|
| 1 | Clean | Parco ® Cleaner 1533 | Spray | 120 | 50 |
| 2 | Rinse | City water | Spray | 60 | 38 |
| 3 | Rinse | Deionized water | Spray | 60 | 25 |
| 4 | Pre-treatment | Pretreatment | Immersion | 120 | 25 |
| 5 | Rinse | Deionized water | Spray | 60 | 25 |

TABLE 24

| Example | Zr ppm | Cu ppm | $SiO_2$ ppm | F total ppm | F free ppm | Zn ppm | $NO_3$ ppm | $H_2O_2$ ppm | pH |
|---|---|---|---|---|---|---|---|---|---|
| 39 control | 150 | 10 | 50 | 200 | 35 | 0 | 100 | 0 | 4.00 |
| 40 | 150 | 10 | 50 | 200 | 35 | 0 | 100 | 10 | 4.00 |
| 41 | 150 | 10 | 50 | 200 | 35 | 0 | 100 | 20 | 4.00 |
| 42 | 150 | 10 | 50 | 200 | 35 | 0 | 100 | 30 | 4.00 |
| 43 | 150 | 10 | 50 | 200 | 35 | 600 | 1600 | 0 | 4.00 |
| 44 | 150 | 10 | 50 | 200 | 35 | 600 | 1600 | 10 | 4.00 |
| 45 | 150 | 10 | 50 | 200 | 35 | 600 | 1600 | 20 | 4.00 |
| 46 | 150 | 10 | 50 | 200 | 35 | 600 | 1600 | 30 | 4.00 |

TABLE 25

| Example | Zr coating weight $mg/m^2$ |
|---|---|
| 39 control | 130 |
| 40 | 112 |
| 41 | 94 |
| 42 | 106 |
| 43 | 94 |
| 44 | 120 |
| 45 | 103 |
| 46 | 113 |

TABLE 26

| Example | Average creep mm | Maximum creep mm |
|---|---|---|
| B-958 | 2.1 | 2.7 |
| 39 control | 2.9 | 4.9 |
| 40 | 2.8 | 4.1 |
| 41 | 2.5 | 3.3 |
| 42 | 2.2 | 3.3 |
| 43 | 3.3 | 4.5 |
| 44 | 2.3 | 4.0 |
| 45 | 1.9 | 3.5 |
| 46 | 2.0 | 3.0 |

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A metal pretreatment coating composition comprising the following components: 50 to 300 ppm of zirconium; 10 to 50 ppm of copper; 10 to 100 ppm of $SiO_2$; 150 to 2000 ppm total fluorine; 10 to 100 ppm free fluorine; 600 to 7900 ppm zinc; and 10 to 10,000 ppm of an oxidizing agent; and having an acidic pH; wherein at least one oxidizing agent is nitrate, present in an amount of from 600 to 10,000 ppm and said components are selected such that the coating composition is capable of depositing an amount of zirconium and a coating thickness that are both less than an otherwise identical coating composition that is devoid of zinc under the same process conditions.

2. The metal pretreatment coating composition according to claim 1 comprising 75 to 300 ppm of zirconium, 10 to 40 ppm of copper and 20 to 100 ppm of $SiO_2$.

3. The metal pretreatment coating composition according to claim 1 wherein said oxidizing agent comprises at least one of a nitrite ion or salt, an inorganic peroxide, a permanganate ion or salt, a persulfate ion or salt, a perborate ion or salt, a chlorate ion or salt, a hypochlorite ion or salt, a vanadate ion or salt, a vanadyl ion or salt, a ceric ion or salt, a tungstate ion or salt, a stannic ion or salt, a hydroxylamine, a nitro-compound, an amine oxide, hydrogen peroxide, or a mixture thereof.

4. The metal pretreatment coating composition according to claim 3 wherein said oxidizing agent comprises at least one of ammonium nitrate, sodium nitrate, potassium nitrate, sodium nitrite, sodium peroxide, potassium permanganate, sodium persulfate, sodium perborate, sodium chlorate, sodium hypochlorite, sodium vanadate, vanadyl sulfate, ceric sulfate, ceric ammonium sulfate, ceric ammonium nitrate, sodium tungstate, stannic fluoride, hydroxylamine, hydroxylamine sulfate, sodium nitrobenzene sulfonate, sodium m-nitrobenzene sulfonate, and N-methylmorpholine N-oxide.

5. The metal pretreatment coating composition according to claim 3 wherein said oxidizing agent comprises hydrogen peroxide present in an amount of from 10 to 30 ppm.

6. The metal pretreatment coating composition according to claim 1 having a pH of about 3.0 to about 5.0.

7. The metal pretreatment coating composition according to claim 1 wherein said oxidizing agent comprises hydrogen peroxide present in an amount of from 10 to 30 ppm and has a pH of about 3.5 to about 4.5.

8. The metal pretreatment coating composition according to claim 1 wherein said oxidizing agent further comprises an ion or salt of sulfate present in an amount of from 600 to 10000 ppm.

9. The metal pretreatment coating composition according to claim 1 wherein Zn is present in an amount of 900 ppm or more and the oxidizing agent is present in an amount greater than 5000 ppm.

10. The metal pretreatment coating composition according to claim 1 wherein zinc is present in an amount greater than 5000 ppm and the oxidizing agent also contains hydrogen peroxide.

11. The metal pretreatment coating composition according to claim 1 wherein the composition comprises 50-300 ppm of zirconium, 10-50 ppm of copper, 10-100 ppm $SiO_2$, 150-2000 ppm total fluorine, 10-100 ppm free fluorine, 1200 to 4800 ppm zinc, and 3000 to 10,000 ppm nitrate.

12. The metal pretreatment coating composition according to claim 1 wherein the composition comprises 100-200 ppm Zr, 10-40 ppm Cu, 10-100 ppm $SiO_2$, 150-1100 total fluorine, 10-100 ppm free fluorine, 900-5000 ppm Zn, and 2000-10,000 ppm nitrate.

13. The metal pretreatment coating composition according to claim 1 wherein zinc is present in an amount of from 600 to 4800 ppm.

14. The metal pretreatment coating composition according to claim 1 wherein the pretreatment composition contains only further metal ions selected from the group consisting of sodium, potassium, tin, vanadium and cerium.

15. The metal pretreatment coating composition according claim 1, wherein zinc is present in an amount of from 600 to 4800 ppm and the oxidizing agent is present in an amount of 900 to 7000 ppm.

16. The metal pretreatment coating composition according to claim 1, wherein zinc is present in an amount of from 600 to 3000 ppm.

17. The metal pretreatment coating composition according claim 1, wherein zinc is present in an amount of from 600 to 2400 ppm.

18. The metal pretreatment coating composition according claim 1, wherein zinc is present in an amount of from 900 to 3000 ppm.

19. The metal pretreatment coating composition according claim 1, wherein zinc is present in an amount of from 900 to 2700 ppm.

20. The metal pretreatment coating composition according claim 1, wherein the nitrate is present in an amount of from 1,000 to 10,000 ppm.

21. The metal pretreatment coating composition according claim 1, wherein the nitrate is present in an amount of from 5500 to 10,000 ppm.

22. A metal pretreatment coating composition consisting of: 50 to 300 ppm of zirconium, 10 to 50 ppm of copper, 10 to 100 ppm of $SiO_2$, 150 to 2000 ppm total fluorine, 10 to 100 ppm free fluorine, 600 to 7900 ppm zinc, and 10 to 10,000 ppm of an oxidizing agent.

23. The metal pretreatment coating composition according to claim 22 wherein hydrogen peroxide is present as an oxidizing agent in an amount of from 10 to 100 ppm.

24. A metal pretreatment coating composition comprising: 50 to 300 ppm of zirconium, 10 to 50 ppm of copper, 10 to 100 ppm of $SiO_2$, 150 to 2000 ppm total fluorine, 10 to 100 ppm free fluorine, 600 to 7900 ppm zinc, and 10 to 10000 ppm of an oxidizing agent, and wherein the pretreatment composition contains only further metal ions selected from the group consisting of sodium, potassium, tin, vanadium and cerium, wherein said components are selected such that the coating composition is capable of depositing an amount of zirconium and a coating thickness on a metal substrate that are both less than an otherwise identical coating composition that is devoid of zinc under the same process conditions.

25. The metal pretreatment coating composition according to claim 24 wherein zinc is present in an amount of from 600 to 4800 ppm.

26. The metal pretreatment coating composition according to claim 24, wherein zinc is present in an amount of from 600 to 3000 ppm.

27. The metal pretreatment coating composition according claim 24, wherein zinc is present in an amount of from 600 to 2400 ppm.

28. The metal pretreatment coating composition according claim 24, wherein zinc is present in an amount of from 900 to 3000 ppm.

29. The metal pretreatment coating composition according claim 24, wherein zinc is present in an amount of from 900 to 2700 ppm.

30. The metal pretreatment coating composition according to claim 24, wherein said oxidizing agent comprises at least one of a nitrite ion or salt, an inorganic peroxide, a persulfate ion or salt, a perborate ion or salt, a chlorate ion or salt, a hypochlorite ion or salt, a vanadate ion or salt, a vanadyl ion or salt, a ceric ion or salt, a stannic ion or salt, a hydroxylamine, a nitro-compound, an amine oxide, or a mixture thereof.

31. The metal pretreatment coating composition according claim 24, wherein at least one oxidizing agent is nitrate, present in an amount of from 600 to 10,000 ppm.

32. The metal pretreatment coating composition according claim 24, wherein said oxidizing agent comprises an ion or salt of sulfate present in an amount of from 600 to 10,000 ppm.

* * * * *